United States Patent [19]

McRee, Jr.

[11] 3,965,828

[45] June 29, 1976

[54] WASTE FEEDING APPARATUS FOR INCINERATOR

[75] Inventor: Robert E. McRee, Jr., Charlotte, N.C.

[73] Assignee: Environmental Control Products, Inc., Charlotte, N.C.

[22] Filed: Feb. 27, 1975

[21] Appl. No.: 553,794

[52] U.S. Cl. ..... 110/8 R; 110/116; 110/173 R

[51] Int. Cl.[2] ..... F23G 5/00; F23M 7/00

[58] Field of Search ..... 110/8 R, 8 C, 18 R, 110/18 C, 116, 118, 173 R

[56] References Cited

UNITED STATES PATENTS

| | | | |
|---|---|---|---|
| 1,211,979 | 1/1917 | Stacy | 110/118 |
| 3,457,881 | 7/1969 | Test et al. | 110/173 X |
| 3,742,875 | 7/1973 | Eberle | 110/116 |
| 3,785,304 | 1/1974 | Stookey | 110/118 |
| 3,841,239 | 10/1974 | Nakamura et al. | 110/8 |

*Primary Examiner*—Kenneth W. Sprague
*Attorney, Agent, or Firm*—Bell, Seltzer, Park & Gibson

[57] ABSTRACT

Apparatus for feeding waste material including pathological or highly infectuous waste into an incinerator combustion chamber through an access opening in the top thereof and being characterized by a construction which substantially prohibits the escape of fumes, smoke or particulate matter from the incinerator. The feeding apparatus includes a generally vertically extending, enclosed, stationary chute in communication with the incinerator access opening. A cover door is mounted on the top of the chute for being opened to insert the waste material and for being closed to cover the chute. An interior door is mounted within the chute for being closed to close the passageway through the chute and for receiving and holding the waste material inserted into the chute when the cover door is opened and for being opened to allow gravity feeding of the waste material into the incinerator combustion chamber when the cover door is closed. Preferably, a lower heat insulating door is mounted at the lower end of the chute for being closed when the interior door is closed for insulating the interior door and the chute from the heat of the incinerator to prevent undesirable heating of the waste material within the chute and for being opened when the interior door is opened for feeding of the waste material into the incinerator combustion chamber. Preferably, a blower and spray cleaning devices are provided for purging the chute of undesirable fumes and for cleaning residual matter from the interior door. Also, a control mechanism is provided for automatic sequential operation of the doors.

15 Claims, 7 Drawing Figures

Fig-2
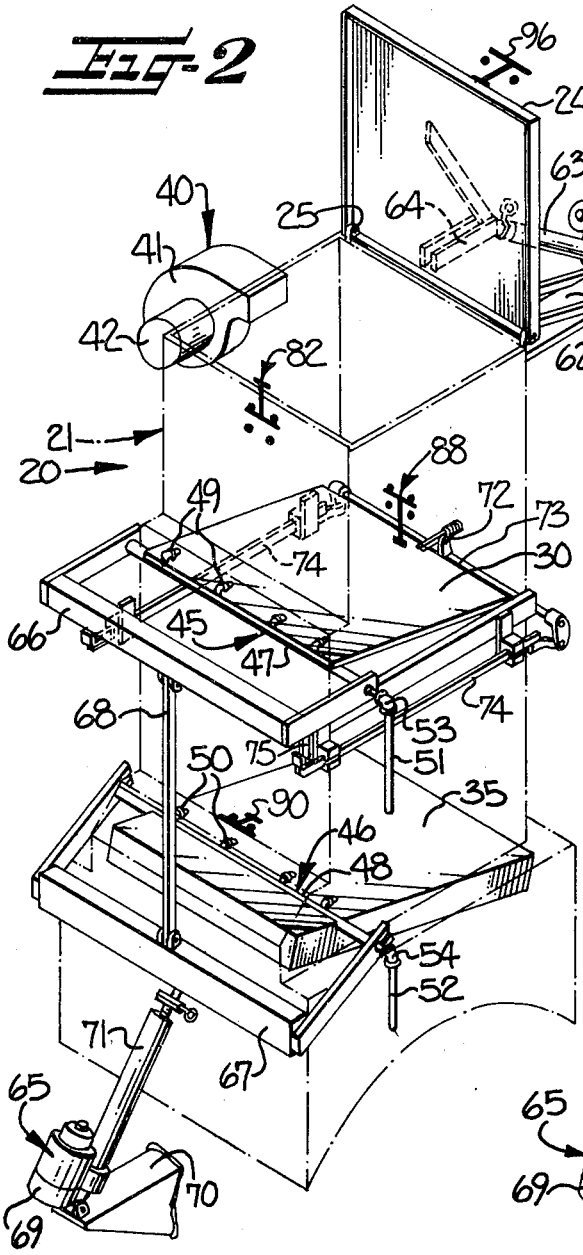
Fig-3
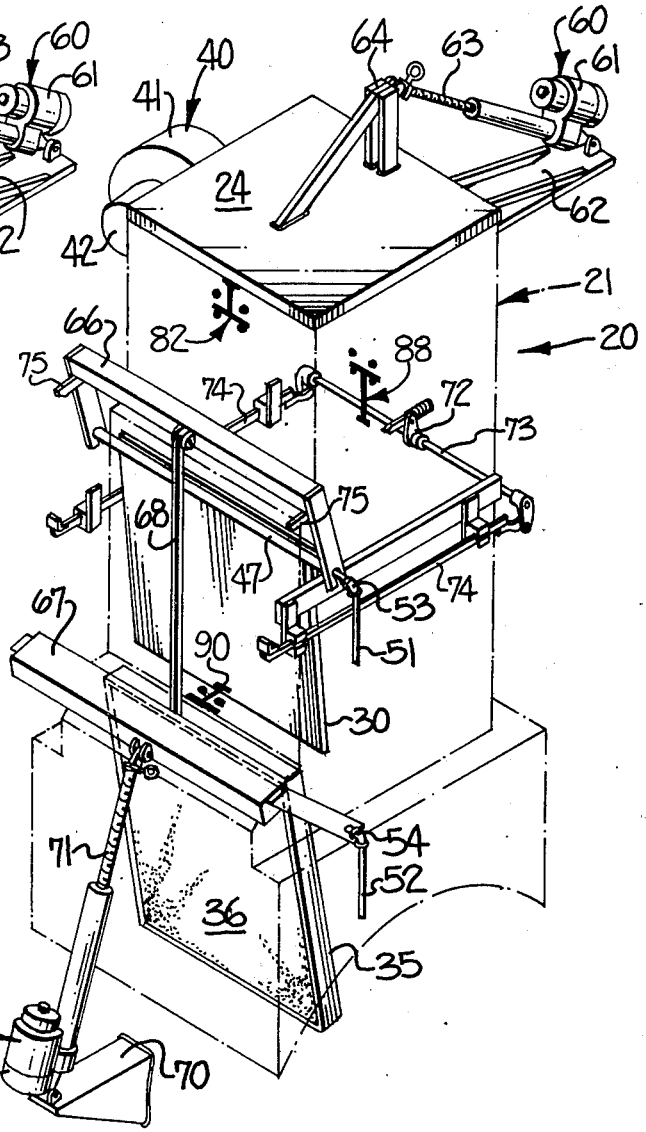
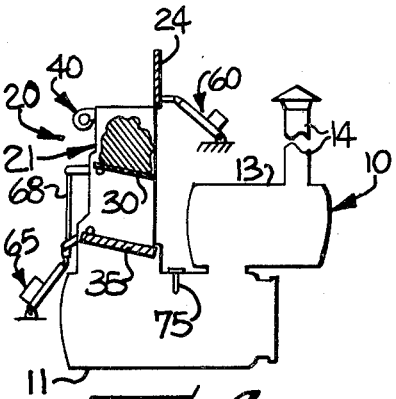
Fig-4
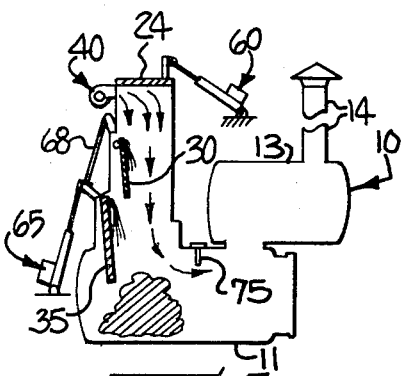
Fig-5
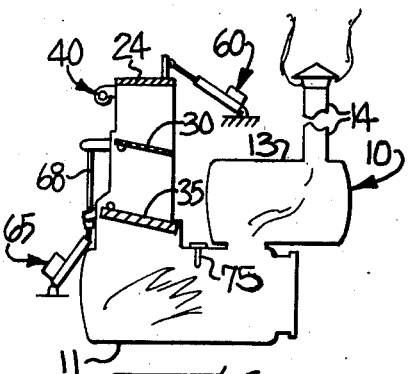
Fig-6

WASTE FEEDING APPARATUS FOR INCINERATOR

This invention relates to a waste feeding apparatus for an incinerator, particularly pathological or highly infectuous waste, which is characterized by a construction which substantially prohibits the escape of fumes, smoke or particulate matter from the incinerator.

BACKGROUND OF THE INVENTION

The feeding of pathological or highly infectuous wastes into an incinerator has long been a problem due to the nature of these pathological or highly infectuous waste materials with respect to leakage or spillage of pathological fluids and the handling of these types of waste materials for inserting them into the incinerator.

Although mechanical feeding systems have been previously proposed for incinerators, these present problems in that all surfaces must be kept clean and the interface between the mechanical feeder and the incinerator charging door must have zero leakage to the working environment. It is not desirable to have the escape of fumes, smoke or particulate matter from the incinerator when incinerating these types of highly infectuous or pathological materials. Mechanical ram type waste feeding systems for incinerators, such as disclosed in U.S. Pat. No. 3,708,087, issued Jan. 2, 1973, and assigned to the assignee of the present invention, would not be appropriate for the feeding of these types of high infectuous or pathological waste materials due to resulting leakage and spillage of the pathological fluids on the moving surfaces and the housekeeping problems with such a mechanical feeding system would become a major nuisance.

SUMMARY OF THE INVENTION

Accordingly, it is an object of this invention to provide a mechanism for feeding materials including pathological or highly infectuous wastes into an incinerator which overcomes the above described problems of leakage and spillage of fluid.

Broadly, it has been determined by this invention that these problems can be overcome to some degree by charging the incinerator or feeding the pathological wastes vertically thereinto and by gravity into the top of the primary combustion chamber with as few moving parts as possible. However, feeding of large animals through a large opening in the top of the chamber presents other problems in that the opening of a large overhead door usually results in problems of emission of combustion gases including fumes, smoke, particulate matter, etc. through the opening to the atmosphere.

Accordingly, it is a further more specific object of this invention to provide a mechanism for feeding materials including pathological or highly infectuous wastes into an incinerator combustion chamber vertically and by gravity and which substantially prohibits the escape of fumes, smoke or particulate matter from the incinerator during the feeding of the waste material thereinto.

It has been found by this invention that this above object may be accomplished by providing means for feeding such waste materials into an incinerator combustion chamber through an access opening in the top portion thereof and which comprises generally the following.

A generally vertically extending, enclosed, stationary chute means is mounted on the incinerator and has open top and bottom ends in which the bottom end is positioned in communication with the access opening in the incinerator combustion chamber for providing a generally vertically extending passageway for gravity flow of the waste materials therethrough and into the incinerator combustion chamber with minimum contact of the waste materials with the walls of the chute means.

A selectively operable cover door means is mounted on the chute means at the top thereof for being opened to insert the waste materials into the chute means and for being closed to cover and close the chute means at the top thereof. A selectively operable interior door means is mounted within the chute means below the cover door means for being closed to cover the passageway through the chute means and for receiving and holding on the top surface thereof the waste material inserted into the chute means when the cover door means is opened and for being opened to allow gravity feeding of the waste material into the combustion chamber of the incinerator when the cover door means is closed.

With the above general construction, the escape of fumes, smoke or particulate matter from the incinerator is prohibited by the interior door means being closed when the cover door means is opened and the cover door means being closed when the interior door means is opened.

In accordance with this invention, it is preferred to have a selectively operable lower heat insulating door means mounted within the chute means generally at the lower open end thereof and below the interior door means for being closed when the interior door means is closed for insulating the interior door means and the chute means from the heat of the incinerator combustion chamber to prevent undesirable heating of the waste material received and held on the interior door means and for being opened when the interior door means is opened to allow gravity feeding of the waste material into the combustion chamber of the incinerator.

It is also preferable to include a blower mechanism carried by the chute means and communicating with the interior passageway therethrough between the cover door and the interior door for blowing air into the chute means when the cover door is closed for maintaining a positive pressure within the chute means to cause an airflow into the incinerator combustion chamber when the interior door is opened for eliminating feedback of fumes, smoke or particulate matter from the incinerator combustion chamber through the chute means for purging the chute means of undesirable fumes. Also, selectively operable cleansing fluid spray devices are preferably supported by the chute means and positioned for spraying a cleansing fluid onto the top surface of the interior door when the interior door is opened for cleaning any residual waste material therefrom.

In accordance with the preferred form of this invention, control mechanisms are operatively connected with the cover door and the interior door and may be connected with the blower and the fluid spray devices for sequential operation of these mechanisms. This control means may include a temperature sensing device operatively positioned with respect to the incinerator combustion chamber for sensing the temperature within the combustion chamber for allowing operation of the control means to open the interior door only when the temperature within the combustion chamber is within a predetermined range.

BRIEF DESCRIPTION OF THE DRAWINGS

Some of the objects and advantages of this invention having been set forth, other objects and advantages of the invention will appear as the description proceeds, when taken in conjunction with the accompanying drawings, in which

FIG. 2 is a perspective view, partially in phantom, of the waste feeding apparatus of this invention illustrating the cover door thereof in the open position;

FIG. 3 is a view, like FIG. 2, illustrating the interior door and lower heat insulating doors in their open positions;

FIGS. 4–6 are schematic, elevational, sectional views illustrating the doors of the waste feeding apparatus of this invention in their various sequential positions of operation for the feeding of waste material into the incinerator.

DESCRIPTION OF PREFERRED EMBODIMENT

Figure 1:
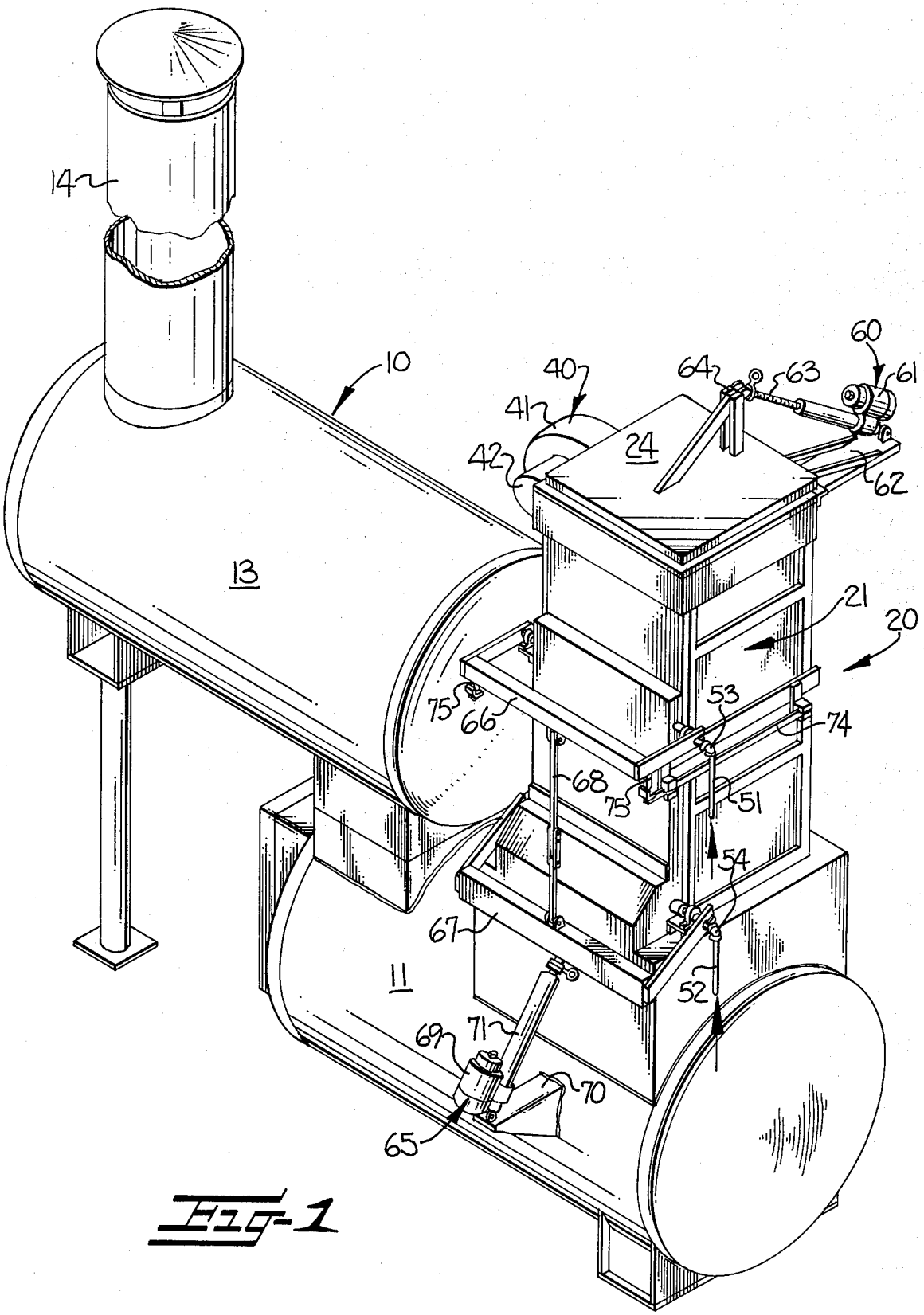
FIG. 1 is a perspective view of an incinerator having the waste feeding apparatus of this invention thereon.

Referring now to the drawings and as may be seen particularly in FIG. 1, the waste feeding apparatus of this invention, generally indicated by the reference numeral 20, is illustrated therein and will be described hereinafter as attached to and in combination with a controlled emission incinerator, generally referred to by the reference numeral 10, which may be of the type disclosed in U.S. Pat. No. 3,453,700, issued Dec. 1, 1970, and assigned to the assignee of the present invention. This incinerator 10 includes a controlled environment main combustion chamber 11 for receiving waste material through an access opening in a top portion thereof. The main combustion chamber 11 communicates with a secondary combustion chamber 13 for secondary burning of the products of incomplete combustion from the main combustion chamber 11 and which includes an exhaust stack 14. The operation of this dual chamber incinerator 10 for the burning of waste material is well understood by those with ordinary skill in the art and further details of the construction and operation thereof may be obtained by reference to the assignee's aforesaid U.S. Pat. No. 3,454,700. Also, it is to be understood that the waste feeding apparatus 20 of this invention may be utilized with other types of incinerators having a combustion chamber with an access opening in the top thereof for receiving the waste material to be burned therein.

The waste feeding apparatus 20 comprises, firstly, a generally vertically extending, enclosed, stationary, chute 21 mounted on the main combustion chamber 11 of the incinerator 10 and having open top and bottom ends in which the bottom end is positioned in communication with the access opening in the top of the main combustion chamber 11 of the incinerator 10 for providing a generally vertically extending passageway therethrough for the gravity flow of waste material therethrough and into the main combustion chamber 11 of the incinerator 10. This chute 21 may be constructed of 11 gauge or heavier steel reinforced with structural members as required and the inside surface of the chute should be smooth and free from any projections or obstructions that would restrict the passage of waste material or cause an accumulation of the waste material. The inside passageway formed by the chute 21 should be of sufficient size to allow passage therethrough of the pathological wastes, including large animals, etc.

The waste feeding apparatus 20 further includes a cover door 24 pivotally mounted by hinges 25 on the chute 21 at the top open end thereof for being selectively operated to be opened to insert waste material into the chute 21 and for being closed to cover and close the chute 21 at the top end thereof. The cover door 24 is preferably gasketed to provide an air tight seal at the open upper end of the chute 21. The cover door 24 may be formed of a similar steel construction as utilized for the chute 21.

There is further provided a selectively operable interior door 30 pivotally mounted within the chute 21 below and spaced from the cover door 24 for being closed to cover the passageway through the chute 21 and for receiving and holding on the top surface thereof the waste material inserted into the chute 21 when the cover door 24 is opened and for being opened to allow gravity feeding of the waste material into the main combustion chamber 11 of the incinerator 10 when the cover door 24 is closed. By this arrangement, the escape of fumes, smoke or particulate matter from the incinerator 10 is prohibited by the interior door 30 being closed when the cover door 24 is opened, and the cover door 24 being closed when the interior door 30 is opened. The interior door 30 may be of steel plate constrction and may be located approximately 4 feet below the cover door 24 and should be of adequate strength to support a 500 pound charge of waste material dropped from a height of 6 feet without damaging the door or its operating mechanisms, to be described below. The chamber formed by the chute 21 between the interior door 30 and the cover door 24 should be of sufficient dimensions to hold a minimum of a 30 gallon container of pathological wastes.

There is further provided a selectively operable lower heat insulating door 35 pivotally mounted within the chute 21 generally at the lower open end thereof and below the interior door 30 for being closed when the interior door 30 is closed for insulating the interior door 30 and the chute 21 from the heat of the incinerator main combustion chamber 11 for preventing undesirable heating of the waste material received and held on the interior door 30 and for being opened when the interior door 30 is opened to allow gravity feeding of the waste material into the main combustion chamber 11 of the incinerator 10.

This lower heat insulating door 35 may also be constructed of steel plate and is preferably refractory lined with refractory material 36 so that it will provide an adequate heat shield for the interior door 30 and the chute 21 and will provide a closure for the main combustion chamber 11 of the incinerator 10. Both the interior door 30 and the lower door 35 should be of suitable construction for cooperating with the interior surface of the chute 21 to prevent the escape of smoke, fumes or particulate matter from the incinerator 10 when the doors are closed.

The waste feeding apparatus 20 further includes selectively operable blower means 40 carried by and mounted on the chute 21 and communicating with the interior passageway through the chute 21 by a suitable aperture therein between the cover door 24 and the interior door 30 for selectively blowing air into the chute 21 when the cover door 24 is closed for maintaining a positive pressure within the chute 21 to cause an air flow into the incinerator main combustion chamber 11 when the interior door 30 and the lower heat insulating door 35 are opened for eliminating feed back of fumes, smoke or particulate matter from the incinerator 10 through the chute 21 for purging the chute 21 of undesirable fumes. The blower means 40 may be in the form of a suitable fan 41 selectively operated by a motor 42.

There is further provided selectively operable cleansing fluid spray means 45 and 46 supported by the chute 21 and positioned for spraying a cleansing fluid onto the top surface of the interior door 30 and the lower heat insulating door 35, respectively, when the interior door 30 and the lower heat insulating door 35 are opened, for cleaning any residual waste material therefrom.

These cleansing fluid spray means 45, 46 comprise hollow, fluid conveying shafts 47, 48 passing through and pivotally mounted in suitable apertures in the chute 21 and being secured to the interior door 30 and the lower heat insulating door 35, respectively, for also providing a pivoting shaft construction for these doors 30, 35. These shafts 47, 48 carry spaced nozzles 49, 50, respectively, along their length which are so positioned for spraying of cleansing fluid received in the shafts 47, 48, respectively, onto the top surfaces of the respective doors 30, 35. Cleansing fluid is supplied to the shafts 47, 48 by fluid conduits 51, 52 respectively, which are joined to the shafts 47, 48 by rotary unions 53, 54, respectively, for allowing pivoting movement of the doors 30, 35 on the shafts 47, 48 for being opened and closed, as discussed above. Cleansing fluid is supplied to the conduits 51, 52 by any suitable supply means (not shown) and the conduits include solenoid operated valves 55 (shown schematically in FIG. 7) for controlling the flow of fluid therethrough.

For controlling the desired sequential operation of the above described components of the waste feeding apparatus 20, there is provided control means operatively connected with the cover door 24, the interior door 30, the lower heat insulating door 35, the blower 40, and the cleansing fluid spray devices 45, 46. This control means performs the sequential operation of (1) opening the cover door 24 while maintaining the interior door 30 and the lower heat insulating door 35 closed for inserting waste material into the chute 21 (as shown in FIG. 4), (2) closing the cover door 24 with the waste material in the chute 21 on the top surface of the closed interior door 30, (3) operating the blower 40 to create a slight positive pressure of approximately 0.1 inches water column to 0.4 inches water column within the chute 21, (4) opening the interior door 30 and the lower heat insulating door 35 while maintaining the cover door 24 closed for gravity flow of the waste material into the incinerator combustion chamber 11 and providing an air flow from the blower 40 into the incinerator combustion chamber 11 for purging the chute 21 of undesirable fumes and for eliminating feed back of fumes, smoke or particulate matter from the incinerator combustion chamber 11 (see FIG. 5), (5) operating the cleansing fluid spray devices 45, 46 for spraying a cleansing fluid onto the top surface of the opened interior door 30 and the lower heat insulating door 35 for cleaning any residual waste material therefrom (see FIG. 5), and (6) closing the interior door 30 and the lower heat insulating door 35 during burning of the waste material thus fed into the incinerator 11 and stopping operation of the blower 40 and the fluid spray devices 45, 46 (see FIG. 6).

By the above operation, the escape of fumes, smoke or particulate matter from the incinerator 11 is prohibited by the interior door 30 and the lower heat insulating door 35 being closed when the cover door 24 is opened and the cover door 24 being closed when the interior door 30 and lower heat insulating door 35 are opened and the chute 21 is purged of objectionable fumes and odors and the interior door 30 and lower heat insulating door 35 are cleaned of residual waste material.

The above described sequentially operated control means comprises drive means 60 connected to the cover door 24 for being selectively actuated to open and close the cover door 24. This drive means comprises a selectively actuated, reversible, electric motor 61 mounted on a platform 62 extending from and secured to the chute 21. The motor 61 is connected to one end of a telescoping screw device 63 and the screw device 63 is connected at its other end to a bracket 64 carried by the upper surface of the cover door 24. By this arrangement, if the motor 61 is rotated in one direction, the telescoping screw device will retract and open the cover door 24 and if the motor 61 is rotated in the opposite direction, the screw device 63 will extend for closing the cover door 24.

The control means of the waste feeding apparatus 20 further includes drive means 65 connected with the interior door 30 and the lower heat insulating door 35 for being selectively actuated to open and close the interior door 30 and lower heat insulating door 35. These doors 30, 35 include means interconnecting the doors 30, 35 for simultaneous opening and closing thereof. This means includes a U-shaped bracket 66 secured to each end of the shaft 47 of the interior door 30 for movement therewith and a U-shaped bracket 67 secured to each end of the shaft 48 of the lower heat insulating door 35 for movement therewith. These U-shaped brackets are interconnected by a rod 68 so that movement of one of the brackets and one of the doors will cause simultaneous movement of the other bracket and the other door. The drive means 65 comprises a selectively actuated, reversible, electric motor 69 carried by a platform 70 extending from and secured to the incinerator main combustion chamber 11. The motor 69 is connected to one end of a telescoping screw device 71 which is connected at its other end to the bracket 67. Accordingly, when the motor 69 is rotated in one direction, the telescoping screw device 71 will retract for simultaneously closing the interior door 30 and the lower heat insulating door 35 and when the motor 69 is rotated in the opposite direction, the telescoping screw device 71 will be extended for simultaneously opening the interior door 30 and lower heat insulating door 35.

The U-shaped brackets 66 and 67 comprise counterweight means for counterbalancing the interior door 30 and the lower heat insulating door 35 for safety purposes, so that if the drive means 65 becomes disconnected from the U-shaped brackets 66, 67, the doors 30, 35 will close by the action of the counterweight means on the doors for having the doors in a closed position for repair, etc.

The interior door 30 is provided with a latch mechanism 72 which is carried by a pivotally mounted shaft 73 contacted by rods 74 which are in turn controlled by studs 75 from the bracket 66, so that when the bracket 66 moves upwardly for opening of the interior door 30, the studs 75 will push against the rod 74 to pivot the shaft 73 and the latch 72 out of engagement with the interior door 30. The latch 72 is for aiding in holding the door 30 in closed position for supporting of waste material on its upper surface.

Figure 7:
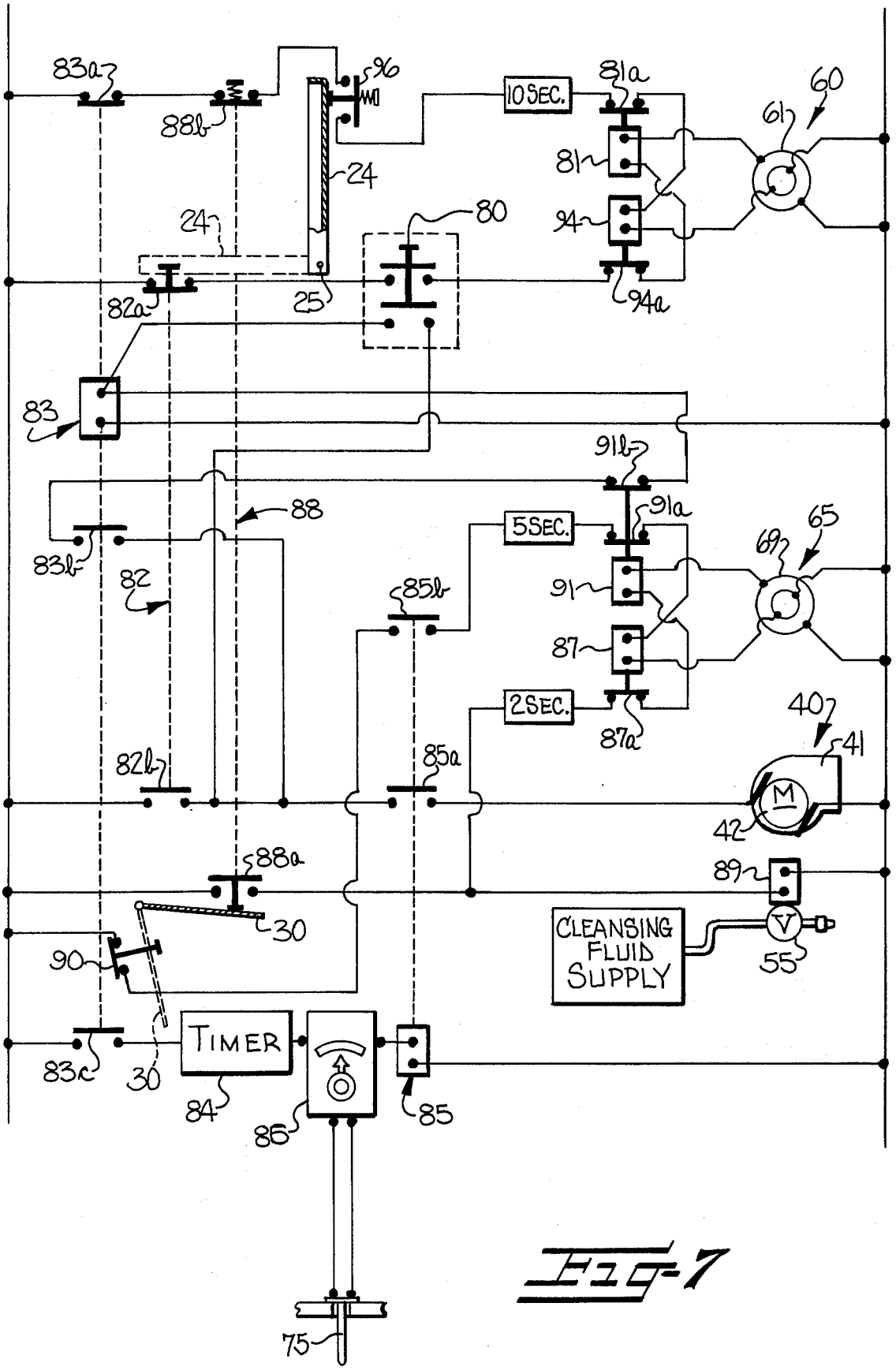
FIG. 7 is a somewhat schematic and diagramatic view illustrating the control mechanism for controlling the operation of the waste feeding apparatus of this invention.

The waste feeding apparatus control means further includes an electrical circuit means, which may be in the form illustrated in FIG. 7, which is connected with the cover door drive means 60, the interior door and lower heat insulating door drive means 65, the blower 40 and both of the spray devices 45, 46 for effecting the above described sequential operation thereof.

The control means preferably further includes a temperature sensing means in the form of a temperature probe 75 connected with the electrical circuit means and extending through a suitable aperture in the wall of the incinerator main combustion chamber 11 for sensing the temperature within the incinerator combustion chamber 11 for allowing operation of the electrical circuit means for actuating the interior door and lower heat insulating door drive means 65 for opening of the interior door 30 and the lower heat insulating door 35 only when the temperature within the incinerator combustion chamber is within a desired predetermined range of temperatures for burning of the waste material inserted therein.

As may be seen in FIG. 7, the electrical circuit means of the waste feeding apparatus control means includes the following components and operates as follows. The waste material is loaded into the chute 21 with the cover door 24 in its open position so as to rest on the top surface of the closed interior door 30. The cover door 24 is closed by manually depressing switch 80 to complete the circuit therethrough. Closing of the switch 80 energizes the solenoid starter 81 of the motor 61 for rotation thereof in the cover door closing direction for extending the telescoping screw device 63 for closing the cover door 24. The switch 81*a* is also opened to prevent rotation of the motor 61 in the opposite direction.

When the cover door 24 is fully closed, a limit switch 82 will be actuated thereby opening switch contact set 82*a* thereof which de-energizes the solenoid starter 81 of the motor 61 of the cover door drive mechanism 60 and closes switch 81*a*. The manually operated push button switch 80 must be held closed until the cover door 24 is fully closed. The thus actuated limit switch 82 closes switch contact set 82*b* and the manually closed switch 80 will allow the energizing of a load relay 83 which maintains or locks the cover door 24 closed by opening the switch contact set 83*a* to prevent rotation of the motor 61 in the opposite direction. Energizing of the load relay 83 also closes switch contact sets 83*b* and 83*c* which energizes program timer 84 and energizes a hold circuit for load relay 83 through switch contact 83*b* so that the manually operated switch 80 may be released. When the program timer 84 completes its cycle, program relay 85 is energized, if the temperature probe 75 operating adjustable switch 86 indicates that a proper temperature has been reached in the incinerator combustion chamber 11.

When the program relay 85 is energized, switch contact set 85*a* will be energized to actuate the blower motor 42 creating a slight positive pressure in the chute 21. Energizing of the program relay 85 in turn energizes the switch contact set 85*b* to energize, after a 5 second timing delay has been completed, the solenoid starter 87 of the motor 69 of the interior door and lower heat insulating door drive means 65 to cause rotation of the telescoping screw device 71 to extend itself for opening of the interior door 30 and the lower heat insulating door 35. This solenoid starter 87 also opens switch 87*a* to prevent rotation of the motor 69 in the opposite direction.

As the interior door 30 is opened, switch contact set 88*a* of limit switch 88 will be closed completing a circuit to solenoid 89 for operating the valve 55 of the cleansing fluid spray devices 45, 46 for initiating a spray of cleansing fluid on the top surfaces of the interior door 30 and the lower heat insulating door 35.

The doors 30, 35 continue to open until the interior door 30 contacts and opens a limit switch 90. When the limit switch 90 is opened, the circuit through solenoid starter 87 is broken to stop rotation of the motor 69 in the open door direction and to allow the switch 87*a* to close. The waste material which had been positioned on the top surface of the interior door 30 will now fall into the main combustion chamber 11 of the incinerator 10 for burning thereof.

Closing of the switch contact set 88*a* upon opening of the interior door 30 completes the circuit through the now closed switch 87*a*, after a 2 second timing delay has been completed, to solenoid starter 91 to rotate the motor 69 in the opposite direction to cause rotation of the screw device 71 for contacting the screw device and causing the interior door 30 and the lower heat insulating door 35 to begin closing. Switch contact sets 91*a* and 91*b* are opened thereby to prevent rotation of the motor 69 in the opposite direction and to deactivate the holding circuit to load relay 83 allowing switch contact set 83*a* to close.

When the interior door 30 is fully closed, switch contact set 88*a* will be opened and switch contact set 88*b* will be closed by contact of the door 30 in its closed position on limit switch 88. Opening of the switch contact set 88*a* will deactuate solenoid 89 shutting off operation of the cleansing fluid devices 45, 46 and will open the circuit through solenoid starter 91 to stop rotation of the motor 69 in the door closed direction.

The switch contact set 88*b* having now been closed by closing of the door 30, a circuit will be completed through solenoid starter 94, after a 10 second timing delay has been completed, which will also open the switch 94*a*. Actuation of the solenoid starter 94 will cause rotation of the motor 61 in the door open direction for contacting the screw device 63 for opening of the cover door 24. When the cover door 24 is opened, limit switch 96 will be opened to open the circuit through solenoid starter 94 to stop operation of the motor 61 and close the switch 94*a*. The switch contact set 82*b* has now been opened and the load relay 83 has been deactivated which in turn will deactuate the program relay 85 and the motor 42 of the blower 40.

The sequential operation of the control means is now completed and the waste feeding apparatus is ready for another operation.

In the drawings and specification there has been set forth a preferred embodiment of this invention, and although specific terms are employed, they are used in a generic and descriptive sense only and not for purposes of limitation.

What is claimed is:

1. In an incinerator including a combustion chamber for burning waste material and having an access opening in a top portion thereof for the introduction of waste material therein by gravity; the combination therewith of means for feeding material including pathological or highly infectuous wastes into the incinerator combustion chamber through the access opening for burning and being characterized by a construction which substantially prohibits the escape of fumes, smoke or particulate matter from the incinerator, said feeding means comprising:

generally vertically extending, enclosed, stationary, chute means mounted on the incinerator and having open top and bottom ends in which said bottom end is positioned in communication with the access opening in the incinerator combustion chamber for providing a generally vertically extending passageway for gravity flow of the waste material therethrough and into the incinerator combustion chamber;

selectively operable cover door means mounted on said chute means at said top end thereof for being opened to insert the waste material into said chute means and for being closed to cover and close said chute means at the top thereof; and selectively operable interior door means mounted within said chute means below said cover door means for being closed to close the passageway through said chute means and for receiving and holding on the top surface thereof the waste material inserted into said chute means when said cover door means is opened and for being opened to allow gravity feeding of the waste material into the combustion chamber of the incinerator when said cover door means is closed;

whereby the escape of fumes, smoke or particulate matter from the incinerator is prohibited by said interior door means being closed when said cover door means is opened and said cover door means being closed when said interior door means is opened.

2. In an incinerator, as set forth in claim 1, further including selectively operable lower heat insulating door means mounted within said chute means generally at said lower open end thereof and below said interior door means for being closed when said interior door means is closed for insulating said interior door means and said chute means from the heat of the incinerator combustion chamber to prevent undesirable heating of the waste material received and held on said interior door means and for being opened when said interior door means is opened to allow gravity feeding of the waste material into the combustion chamber of the incinerator.

3. In an incinerator, as set forth in claim 2, further including means interconnecting said interior door means and said lower heat insulating door means for opening and closing of both simultaneously.

4. In an incinerator, as set forth in claim 1, further including selectively operable blower means carried by said chute means and communicating wiith the interior passageway therethrough between said cover door means and said interior door means for blowing air into said chute means when said cover door means is closed for maintaining a positive pressure within said chute means to cause an air flow into the incinerator combustion chamber when said interior door means is opened for eliminating feedback of fumes, smoke or particulate matter from the incinerator combustion chamber through said chute means for purging said chute means of undesirable fumes.

5. In an incinerator, as set forth in claim 1, further including selectively operable cleansing fluid spray means supported by said chute means and positioned for spraying a cleansing fluid onto the top surface of said interior door means, when said interior door means is opened, for cleaning any residual waste material therefrom.

6. In an incinerator including a combustion chamber for burning waste material and having an access opening in a top portion thereof for the introduction of waste material therein by gravity; the combination therewith of means for feeding material including pathological or highly infectuous wastes into the incinerator combustion chamber through the access opening for burning and being characterized by a construction which substantially prohibits the escape of fumes, smoke or particulate matter from the incinerator, said feeding means comprising:

generally vertically extending, enclosed, stationary, chute means mounted on the incinerator and having open top and bottom ends in which said bottom end is positioned in communication with the access opening in the incinerator combustion chamber for providing a generally vertically extending passageway for gravity flow of the waste material therethrough and into the incinerator combustion chamber;

cover door means pivotally mounted on said chute means for being opened to insert the waste material into said chute means and for being closed to cover and close said chute means at the top thereof;

interior door means pivotally mounted within said chute means below said cover door means for being closed to close the passageway through said chute means and for receiving and holding on the top surface thereof the waste material inserted into said chute means and for being opened to allow gravity feeding of the waste material into the incinerator combustion chamber; and control means operatively connected with said cover door means and said interior door means for sequential operation thereof (1) for opening said cover door means while maintaining said interior door means closed for inserting waste material into said chute means, (2) for closing said cover door means with the waste material in said chute means on said closed interior door means, (3) for opening said interior door means while maintaining said cover door means closed for gravity flow of the waste material into the incinerator combustion chamber, and (4) for closing said interior door means during burning of the waste material;

whereby the escape of fumes, smoke or particulate matter from the incinerator is prohibited by said interior door means being closed when said cover door means is opened and said cover door means being closed when said interior door means is opened.

7. In an incinerator, as set forth in claim 6, in which said control means comprises drive means connected to said cover door means for being selectively actuated to open and close said cover door means, drive means connected to said interior door means for being selectively actuated to open and close said interior door means, and electrical circuit means, connected with said cover door drive means and said interior door drive means and including switch means operatively positioned for being operated by said cover door means and said interior door means in the open and closed positions thereof, for operating said cover door drive means and said interior door drive means for the sequential operation thereof.

8. In an incinerator, as set forth in claim 7, in which said control means further includes a temperature sensing means connected with said electrical circuit means and operatively positioned with respect to the incinerator combustion chamber for sensing the temperature within the incinerator combustion chamber and allowing operation of said electrical circuit means for actuating said interior door drive means for opening said interior door means only when the temperature within the incinerator combustion chamber is within a predetermined range.

9. In an incinerator, as set forth in claim 6, further including blower means carried by said chute means and communicating with the interior passageway therethrough between said cover door and said interior door means and connected with said control means for being selectively operated thereby for blowing air into said chute means when said cover door means is closed for maintaining a positive pressure within said chute means to cause an air flow into the incinerator combustion chamber when said interior door means is opened for eliminating feed back of fumes, smoke or particulate matter from the incinerator combustion chamber through said chute means for purging said chute means of undesirable fumes.

10. In an incinerator, as set forth in claim 6, further including cleansing fluid spray means supported by said chute means and positioned at least partly within the passageway formed thereby and connected with said control means for being selectively operated thereby for spraying a cleansing fluid onto the top surface of said interior door means when said interior door means is opened for cleaning any residual waste therefrom.

11. In an incinerator including a combustion chamber for burning waste material and having an access opening in a top portion thereof for the introduction of waste material therein by gravity; the combination therewith of means for feeding material including pathological or highly infectuous wastes into the incinerator combustion chamber through the access opening for burning and being characterized by a construction which substantially prohibits the escape of fumes, smoke or particulate matter from the incinerator, said feeding means comprising:

generally vertically extending, enclosed, stationary, chute means mounted on the incinerator and having open top and bottom ends in which said bottom end is positioned in communication with the access opening in the incinerator combustion chamber for providing a generally vertically extending passageway for gravity flow of the waste material therethrough and into the incinerator combustion chamber;

cover door means pivotally mounted on said chute means said top end thereof for being opened to insert the waste material into said chute means and for being closed to cover and close said chute means at the top thereof;

interior door means pivotally mounted within said chute means below said cover door means for being closed to close the passageway through said chute means and for receiving and holding on the top surface thereof the waste material inserted into said chute means and for being opened to allow gravity feeding of the waste material into the incinerator combustion chamber;

lower heat insulating door means pivotally mounted within said chute means generally at said lower open end thereof and below said interior door means for being closed when said interior door means is closed for insulating said interior door means and said chute means from the heat of the incinerator combustion chamber for preventing undesirable heating of the waste material received and held on said interior door means and for being opened when said interior door means is opened to allow gravity feeding of the waste material into the combustion chamber of the incinerator; and control means operatively connected with said cover door means, said interior door means and said lower heat insulating door means for sequential operation thereof (1) for opening said cover door means while maintaining said interior door means and said lower heat insulating door means closed for inserting waste material into said chute means, (2) for closing said cover door means with the waste material in said chute means on said closed interior door means, (3) for opening said interior door means and said lower heat insulating door means while maintaining said cover door means closed for gravity flow of the waste material into the incinerator combustion chamber, and (4) for closing said interior door means and said lower heat insulating door means during burning of the waste material;

whereby the escape of fumes, smoke or particulate matter from the incinerator is prohibited by said interior door means and said lower heat insulating door means being closed when said cover door means is open and said cover door means being closed when said interior door means and said lower heat insulating door means are opened.

12. In an incinerator including a combustion chamber for burning waste material and having an access opening in a top portion thereof for the introduction of waste material therein by gravity; the combination therewith of means for feeding material including pathological or highly infectuous wastes into the incinerator combustion chamber through the access opening for burning and being characterized by a construction which substantially prohibits the escape of fumes, smoke or particulate matter from the incinerator, said feeding means comprising:

generally vertically extending, enclosed, stationary, chute means mounted on the incinerator and having open top and bottom ends in which said bottom end is positioned in communication with the access opening in the incinerator combustion chamber for providing a generally vertically extending passageway for gravity flow of the waste material therethrough and into the incinerator combustion chamber;

cover door means mounted on said chute means at said top end thereof for being opened to insert the waste material into said chute means and for being closed to cover and close said chute means at the top thereof;

interior door means mounted within said chute means below said cover door means for being closed to cover the passageway through said chute means and for receiving and holding on the top surface thereof the waste material inserted into said chute means and for being opened to allow gravity feeding of the waste material into the incinerator combustion chamber;

blower means carried by said chute means and communicating with the interior passageway therethrough between said cover means and said interior door means for being operated to blow air into said chute means when said cover door means is closed for maintaining a positive pressure within said chute means to cause an airflow into the incinerator combustion chamber when said interior door means is opened;

selectively operable cleansing fluid spray means supported by said chute means and positioned for spraying a cleansing fluid onto the top surface of said interior door for cleaning any residual waste material therefrom; and control means operatively connected with said cover door means, said interior door means, said blower means and said fluid spray means for sequential operation thereof (1) for opening said cover door means while maintaining said interior door means closed for inserting waste material into said chute means, (2) for closing said cover door means with the waste material in said chute means on said closed interior door means, (3) for operating said blower means, (4) for opening said interior door means while maintaining said cover door means closed for gravity flow of the waste material into the combustion chamber and providing an air flow from said blower means into the incinerator combustion chamber for purging said chute means of undesirable fumes and for eliminating feed back of fumes, smoke or particulate matter from the incinerator combustion chamber, (5) for operating said cleansing fluid spray means for spraying a cleansing fluid onto the top surface of said interior door means for cleaning any residual waste material therefrom, and (6) for closing said interior door means during burning of the waste material and stopping operation of said blower means and said fluid spray means;

whereby the escape of fumes, smoke or particulate matter from the incinerator is prohibited by said interior door means being closed when said cover door means is opened and said cover door means being closed when said interior door means is opened and said chute means is purged of objectional fumes and odors and said interior door means is cleaned.

13. In an incinerator, as set forth in claim 12, further including selectively operable lower heat insulating door means mounted within said chute means generally at said lower open end thereof and below said interior door means and being operatively connected with said control means for operation thereby for being closed when said interior door means is closed for insulating said interior door means and said chute means from the heat of the incinerator combustion chamber to prevent undesirable heating of the waste material received and held on said interior door means and for being opened when said interior door means is opened to allow gravity feeding of the waste material into the incinerator combustion chamber, and means interconnecting said interior door means and said lower heat insulating door means for simultaneous opening and closing of said interior door means and said lower heat insulating door means.

14. In an incinerator, as set forth in claim 13, further including selectively operable cleansing fluid spray means supported by said chute means and operatively connected with said control means for being operated thereby for spraying a cleansing fluid onto the top surface of said lower heat insulating door means when said lower heat insulating door means is opened for cleaning any residual waste material therefrom.

15. In an incinerator, as set forth in claim 14, in which said control means comprises drive means connected to said cover door means for being selectively actuated to open and close said cover door means, drive means connected with said means interconnecting said interior door means and said lower heat insulating door means for being selectively actuated to open and close said interior door means and said lower heat insulating door means, electrical circuit means, connected with said cover door drive means, said interior door and said lower heat insulating door drive means, said blower means, and both of said spray means and including switch means operatively positioned for being operated by said cover means and said interior door means in the open and closed positions thereof, for operating both of said door drive means, said blower means and both of said spray means for the sequential operation thereof, and a temperature sensing means connected with said electrical circuit means and operatively positioned with respect to the incinerator combustion chamber for sensing the temperature within the incinerator combustion chamber for allowing operation of said electrical circuit means for actuating said interior door and said lower heat insulating door drive means for opening of said interior door and said lower heat insulating door means only when the temperature within the incinerator combustion chamber is within a predetermined range.

* * * * *